US011506210B2

(12) United States Patent
Zhao et al.

(10) Patent No.: US 11,506,210 B2
(45) Date of Patent: Nov. 22, 2022

(54) CENTRIFUGAL COMPRESSOR AND REFRIGERATING DEVICE

(71) Applicant: Carrier Corporation, Palm Beach Gardens, FL (US)

(72) Inventors: Hao Zhao, Shanghai (CN); Xi Feng, Shanghai (CN); Shuguang Zhang, Shanghai (CN); Jun Cao, Shanghai (CN); Huanan Li, Shanghai (CN); Shuang Lu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,854

(22) PCT Filed: Sep. 10, 2020

(86) PCT No.: PCT/US2020/050098
§ 371 (c)(1),
(2) Date: Dec. 3, 2020

(87) PCT Pub. No.: WO2021/050662
PCT Pub. Date: Mar. 18, 2021

(65) Prior Publication Data

US 2021/0364001 A1 Nov. 25, 2021

(30) Foreign Application Priority Data

Sep. 12, 2019 (CN) ..... 201910863359.4

(51) Int. Cl.
*F04D 17/12* (2006.01)
*F04D 17/10* (2006.01)
(Continued)

(52) U.S. Cl.
CPC ..... *F04D 17/122* (2013.01); *F04D 17/10* (2013.01); *F04D 25/0606* (2013.01);
(Continued)

(58) Field of Classification Search
CPC .... F04D 25/0606; F04D 17/10; F04D 17/122; F04D 29/063; F04D 29/4206; F04D 29/441; F04D 29/582
See application file for complete search history.

(56) References Cited

U.S. PATENT DOCUMENTS 4,623,306 A 11/1986 Nakamura et al.
5,533,875 A * 7/1996 Crum ..... F04C 23/008 417/368

(Continued)

FOREIGN PATENT DOCUMENTS

CN 202100491 U 1/2012
CN 105874203 B 1/2018

(Continued)

OTHER PUBLICATIONS

International Search Report and Written Opinion for Application No. PCT/US2020/050098; dated Dec. 10, 2020 14 Pages.

(Continued)

*Primary Examiner* — Kenneth J Hansen
(74) *Attorney, Agent, or Firm* — Cantor Colburn LLP

(57) ABSTRACT

A centrifugal compressor and a refrigerating device. The compressor includes: a shell, which has a fluid inlet at a first position of the shell, and a fluid outlet at a second position of the shell, a motor assembly, which is arranged in the shell and includes a stator and a rotor, the rotor including a vertically arranged rotor shaft, and the rotor shaft including a lower end and an upper end; a centrifugal compression mechanism, an impeller of which is connected with the rotor shaft so as to be driven by the motor assembly; and a guide member, which is located above the centrifugal compression mechanism, and which defines a flow passage alone or together with a top part of the shell.

9 Claims, 2 Drawing Sheets

(51) Int. Cl.

| | |
|---|---|
| ***F04D 25/06*** | (2006.01) |
| ***F04D 29/056*** | (2006.01) |
| ***F04D 29/063*** | (2006.01) |
| ***F04D 29/42*** | (2006.01) |
| ***F04D 29/44*** | (2006.01) |

(52) U.S. Cl.
CPC ..... *F04D 29/056* (2013.01); *F04D 29/063* (2013.01); *F04D 29/4206* (2013.01); *F04D 29/441* (2013.01)

(56) References Cited

U.S. PATENT DOCUMENTS

| | | | | |
|---|---|---|---|---|
| 5,660,539 | A | 8/1997 | Matsunaga et al. | |
| 6,000,917 | A | 12/1999 | Smerud et al. | |
| 6,098,753 | A | 8/2000 | Lamarre et al. | |
| 6,139,295 | A | 10/2000 | Utter et al. | |
| 6,179,593 | B1 | 1/2001 | Mitsuya et al. | |
| 7,293,970 | B2 | 11/2007 | Sato | |
| 7,322,809 | B2 | 1/2008 | Kitaura et al. | |
| 8,127,567 | B2 | 3/2012 | Ogata et al. | |
| 8,133,043 | B2 | 3/2012 | Duppert | |
| 9,217,434 | B2 | 12/2015 | Han et al. | |
| 9,885,357 | B2 | 2/2018 | Yokoyama et al. | |
| 2003/0143093 | A1 | 7/2003 | Mabe et al. | |
| 2006/0099086 | A1* | 5/2006 | Morozumi | F04C 29/02 417/65 |
| 2008/0152478 | A1* | 6/2008 | Yen | F04D 25/06 415/111 |
| 2014/0341710 | A1* | 11/2014 | Creamer | F04D 27/007 415/111 |
| 2017/0306951 | A1* | 10/2017 | Chikano | F04C 23/008 |
| 2018/0231006 | A1* | 8/2018 | Sun | F04D 17/08 |

FOREIGN PATENT DOCUMENTS

| | | | |
|---|---|---|---|
| CN | 106567833 | B | 1/2019 |
| EP | 3361104 | A1 | 8/2018 |
| JP | H11294879 | A | 10/1999 |

OTHER PUBLICATIONS

International Search Report and Written Opinion for Application No. PCT/US2020/050098; dated Dec. 10, 2020 9 Pages.

* cited by examiner

CENTRIFUGAL COMPRESSOR AND REFRIGERATING DEVICE

CROSS-REFERENCE TO RELATED APPLICATIONS

This application is a National Stage of International Application Serial No. PCT/US2020/050098, filed Sep. 10, 2020, which claims the benefit of CN Application No. 201910863359.4, filed on Sep. 12, 2019, both of which are incorporated by reference in their entirety herein.

FIELD OF THE INVENTION

The present disclosure relates to the field of compressors; more specifically, the present disclosure relates to a centrifugal compressor and a refrigerating device having the same.

BACKGROUND OF THE INVENTION

For centrifugal compressors, they are often used in large refrigeration units and typically use bearings that do not require lubrication (oil-free bearings). When high-speed small centrifugal compressors are desired, the cost of high-speed oil-free bearings is too high. It is therefore desirable to provide bearings that require lubrication and to design simplified oil circuits. On the other hand, it is desirable to simplify the structure of the centrifugal compressor, so that a compact and small centrifugal compressor can be provided.

SUMMARY OF THE INVENTION

An object of the present disclosure is to solve or at least alleviate the problems existing in the related art.

In an aspect, a centrifugal compressor, especially a vertically arranged centrifugal compressor, is provided, which includes:

a shell, which has a fluid inlet at a first position of the shell, and a fluid outlet at a second position of the shell, which is higher than the first position;

a motor assembly, which is arranged in the shell and includes a stator and a rotor, the rotor including a vertically arranged rotor shaft, and the rotor shaft including a lower end and an upper end;

a centrifugal compression mechanism, an impeller of which is connected with the rotor shaft so as to be driven by the motor assembly; and a guide member, which is located above the centrifugal compression mechanism, and which defines a flow passage alone or together with a top part of the shell;

wherein when the centrifugal compressor is working, a fluid from the fluid inlet passes through the motor assembly and then flows from an outer periphery of the centrifugal compression mechanism into the flow passage from bottom to top, is diverted in the flow passage, thereby enters the centrifugal compression mechanism from top to bottom, and exits from the fluid outlet.

In some embodiments of the centrifugal compressor, the rotor shaft is supported by a first bearing at a lower part and a second bearing at an upper part, a bottom part of the shell has an oil tank, and the lower end of the rotor shaft is located in the oil tank; the rotor shaft defines an axial or oblique oil passage therein, and has radial perforations at positions corresponding to the first bearing and the second bearing.

In some embodiments of the centrifugal compressor, the motor assembly includes:

a motor housing;

a stator fixed on an inner side of the motor housing;

a rotor located radially inwardly of the stator, the rotor being capable of rotating relative to the stator when energized;

a first bearing seat at the bottom of the motor housing and a first bearing therein;

an oil cup at the top of the motor housing; and a second bearing bracket located above the oil cup and a second bearing therein.

In some embodiments of the centrifugal compressor, the bottom of the motor housing is connected to the shell through a support bracket, the top of the motor housing is connected to the second bearing bracket, and the second bearing bracket is supported by the shell; the oil cup includes an oil guide pipe that is arranged obliquely to guide oil in the oil cup to an inner wall of the shell so that the oil is returned to the oil tank at the bottom part of the shell.

In some embodiments of the centrifugal compressor, an outer periphery of the second bearing bracket has a fluid passage that allows fluid to pass through from bottom to top.

In some embodiments of the centrifugal compressor, the centrifugal compression mechanism includes one or more compression stages.

In some embodiments of the centrifugal compressor, the centrifugal compression mechanism includes a first-stage impeller, a partition, a volute, and a second-stage impeller, wherein an outlet of the volute communicates with the fluid outlet of the shell, the fluid passes between an upper surface of the volute and the partition after being compressed by the first-stage impeller, is then compressed by the second-stage impeller, and then exits from the fluid outlet via the outlet of the volute.

In some embodiments of the centrifugal compressor, outer peripheries of the volute and the second bearing bracket have corresponding fluid passages to allow fluid to pass through from bottom to top.

In some embodiments of the centrifugal compressor, the guide member is hemispherical, and the top part of the shell has an inward protrusion.

In another aspect, a refrigerating device is provided, which includes the centrifugal compressor according to various embodiments.

BRIEF DESCRIPTION OF THE DRAWINGS

The contents of the present disclosure will become easier to understand with reference to the accompanying drawings. It can be easily understood by those skilled in the art that the drawings are merely used for illustration, and are not intended to limit the scope of protection of the present disclosure. In addition, like parts are denoted by like numerals in the drawings, wherein.

DETAILED DESCRIPTION OF THE EMBODIMENT(S) OF THE INVENTION

Figure 1:
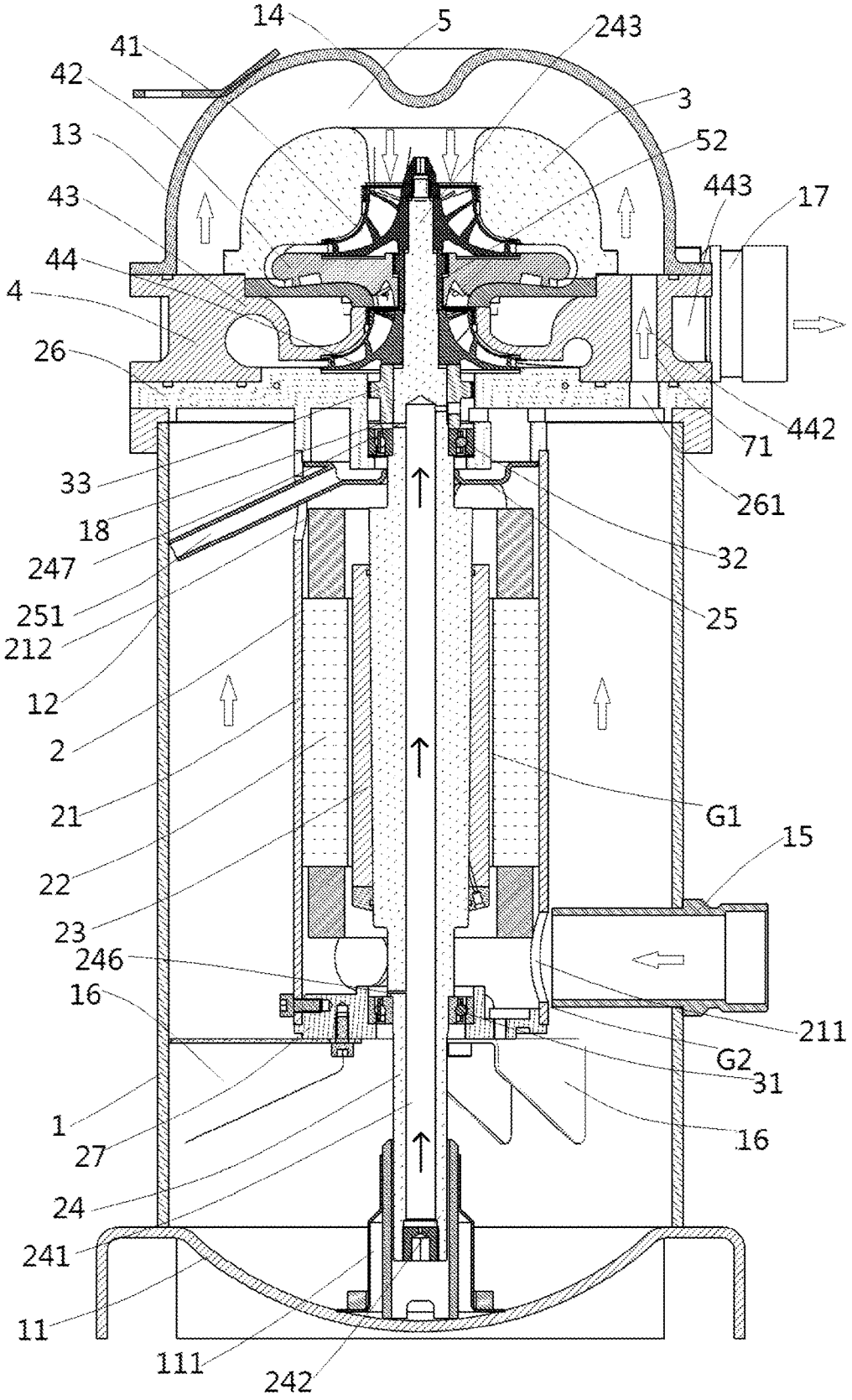
FIG. 1 shows a cross-sectional view of a centrifugal compressor according to an embodiment of the present disclosure.

It can be easily understood that according to the technical solutions of the present disclosure, without changing the essential spirit of the present disclosure, those skilled in the art can propose a variety of mutually replaceable structural modes and implementations. Therefore, the following specific embodiments and the accompanying drawings are merely exemplary illustrations of the technical solutions of the present disclosure, and should not be regarded as the entirety of the present disclosure or as definitions or limitations to the technical solutions of the present disclosure.

The orientational terms that have been mentioned or might be mentioned in this specification, such as "upper", "lower", "left", "right", "front", "rear", "front side", "back side", "top", "bottom", etc., are defined relative to the configurations shown in the drawings. They are relative concepts, so they may change accordingly according to their different locations and different states of use. Therefore, these or other orientational terms should not be interpreted as restrictive terms.

Figure 2:
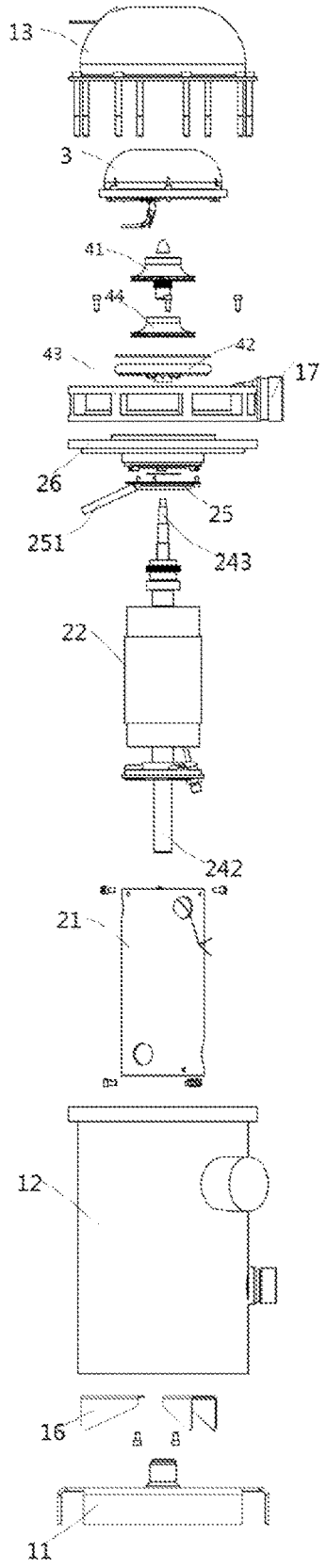
FIG. 2 shows an exploded view of a centrifugal compressor according to an embodiment of the present disclosure.

Referring to FIGS. 1 and 2, a centrifugal compressor is shown, which includes: a shell 1, which has a fluid inlet 15 at a first position of the shell, and a fluid outlet 17 at a second position of the shell, which is higher than the first position; a motor assembly 2, which is arranged in the shell 1 and includes a stator and a rotor, wherein the rotor includes a vertically arranged rotor shaft 24, and the rotor shaft 24 includes a lower end 242 and an upper end 243; a centrifugal compression mechanism 4, an impeller of which is connected with the rotor shaft (such as its upper end 243) so as to be driven by the motor assembly 2; and a guide member 3, which is located above the centrifugal compression mechanism and defines a flow passage 5 alone or together with a top part 13 of the shell 1; wherein when the centrifugal compressor is working, a fluid from the fluid inlet 15 passes through the motor assembly 2 and then flows from an outer periphery of the centrifugal compression mechanism 4 into the flow passage 5 from bottom to top, is diverted in the flow passage 5, thereby enters the centrifugal compression mechanism 4 from top to bottom, and exits from the fluid outlet 17 after being compressed and pressurized by the centrifugal compression mechanism 4, substantially as indicated by the hollow arrows.

In the centrifugal compressor according to the embodiments of the present disclosure, the fluid first passes through the motor assembly 2 and cools the motor assembly 2, including passing through a gap G1 between the rotor and the stator and an outer side of a motor housing 21; then, the fluid flows from a passage located radially outwardly of the centrifugal compression mechanism 4 to the flow passage 5 defined between the guide member 3 and the top part 13 of the shell, is diverted and enters the centrifugal compression mechanism 4 from top to bottom to be compressed and pressurized; for example, the fluid after a two-stage compression and pressurization is finally discharged from the fluid outlet 17. A feature of the centrifugal compressor according to the embodiments of the present disclosure is the use of intake air to cool the motor assembly; that is, for example, an intake air flow from an evaporator is directly guided to the motor assembly 2 to cool the motor assembly 2. Since the fluid according to the embodiments of the present disclosure passes through the centrifugal compression mechanism 4 from top to bottom, when the centrifugal compression mechanism 4 is working, the impeller thereof will exert an upward force on the rotor shaft 24, which counteracts the gravity of the rotor shaft 24 itself, thereby reducing axial stress of bearings 31 and 32 that support the rotor shaft 24. In addition, the device according to this embodiment provides a centrifugal compressor with a compact design so as to be applied to low-power operating conditions.

In the illustrated embodiment, the rotor shaft 24 is supported by a first bearing 31 at a lower part and a second bearing 32 at an upper part. The first bearing 31 is disposed in a first bearing seat 27 at the bottom of the motor assembly 2, and the second bearing 32 is disposed in a second bearing bracket 26 at the top of the motor assembly. The shell 1 substantially includes a bottom part 11, a middle part 12 and a top part 13. The fluid inlet 15 may be formed as a pipe, which may extend in a radial direction and be flush with the bottom of the motor housing 21. In some embodiments, the fluid inlet 15 may, for example, extend to the interior of the shell 1 and be aligned with an opening 211 at the bottom of the motor housing 21. There may be a gap G2 between the fluid inlet 15 and the opening 211, so that the airflow from the fluid inlet 15 partially flows from the gap G1 between the motor stator and the rotor, and partially passes through the outside of the motor assembly 2. The top of the motor housing 21 may also have an opening 212 to allow the airflow passing through the gap G1 to exit, and an oil guide pipe 251 may extend out of the opening 212. The bottom part 11 of the shell 1 has an oil tank. Lubrication oil for the first bearing 31, the second bearing 32 and other optional members may be contained in the oil tank. The lower end 242 of the rotor shaft 24 may be located in the oil tank; specifically, it may be inserted into a limiting member 111 in the oil tank. The rotor shaft 24 defines an axial oil passage 241 therein. For example, as shown in FIG. 1, the rotor shaft may be formed as a hollow member with an oil passage 241 therein. The oil passage 241 may be straight (in the axial direction of the rotor shaft 242) or oblique. The rotor shaft 24 has radial perforations 246 and 247 at positions corresponding to the first bearing 31 and the second bearing 32, respectively. When the centrifugal compressor is working, the rotation of the rotor shaft 24 will generate negative pressure in the oil passage 241, so that the oil in the oil tank is drawn through the oil passage 241 in the direction of the arrows, and the oil will flow radially out of the perforations 246, 247 under centrifugal force, thereby lubricating the first bearing 31 and the second bearing 32. The oil that has passed through and lubricated the first bearing 31 directly returns to the oil tank under gravity. An oil cup 25 is arranged below the second bearing 32. The oil that has passed through and lubricated the second bearing 32 falls into the oil cup 25, is guided to an inner side of a side wall of the shell through the obliquely arranged oil guide pipe 251, and returns to the oil tank along the inner side of the side wall of the shell. The arrangement of the oil cup 25 and the oil guide pipe 251 prevents the lubrication oil from entering the interior of the motor assembly 2. In some embodiments, a diameter of the perforation 246 corresponding to the first bearing 31 may be smaller than a diameter of the perforation 247 corresponding to the second bearing 32 to prevent the oil from flowing out of the perforation 246 too much to reach the perforation 247.

With reference to FIGS. 1 and 2, in the illustrated embodiment, the motor assembly 2 may include: a motor housing 21; a stator 22 fixed on an inner side of the motor housing 21; and a rotor located radially inwardly of the stator. In some embodiments, the rotor may include a rotor shaft 24 and a permanent magnet 23, and the stator 22 may have a winding. When the stator 22 is energized, the rotor is capable of rotating relative to the stator 22. The motor assembly 2 may further include: a first bearing seat 27 at a bottom of the motor housing 21 and a first bearing 31 therein; an oil cup 25 at a top of the motor housing 21; and a second bearing bracket 26 located above the oil cup 25 and a second bearing 32 therein. In an alternative embodiment, the motor assembly 2 may have other suitable structures and components. In the illustrated embodiment, the bottom of the motor housing 21 is connected to the shell 1 through several support brackets 16. For example, the bottom of the motor housing 21 is connected to the inner side of the side wall of the shell 1. The top of the motor housing 21 is connected to the second bearing bracket 26, and the second bearing bracket 26 is mounted on the shell 1, such as being directly supported on the middle part 12 of the shell 1 or connected to the inner wall of the shell 1.

The centrifugal compression mechanism 4 is arranged on the second bearing bracket 26. For example, in some embodiments, a volute 43 of the centrifugal compression mechanism may be directly arranged on the second bearing bracket 26, and outer peripheries of the second bearing bracket 26 and the volute 43 include fluid passages 71 and 442 that allow fluid to pass through from bottom to top. The fluid passages 71 and 442 may be formed as holes or passages distributed along the outer peripheries of the second bearing bracket 26 and the volute 43 at corresponding positions. Although shown in the drawings, the centrifugal compression mechanism 4 includes two stages consisting of a first-stage impeller 41 and a second-stage impeller 44. In an alternative embodiment, the centrifugal compression mechanism 4 may only include one stage or more than two stages. In the illustrated embodiment, the centrifugal compression mechanism 4 includes the first-stage impeller 41, a partition 42, the volute 43, and the second-stage impeller 44, through which the rotor shaft 24 passes. The first-stage impeller 41 and the second-stage impeller 44 are connected to the rotor shaft 24 and rotate with the rotor shaft, whereas the partition 42 and the volute 43 are relatively fixed. A first sleeve 52 is arranged between the first-stage impeller 41 and the second-stage impeller 44, and a second sleeve 33 is arranged between the second-stage impeller 44 and the second bearing 32. In the illustrated embodiment, an outlet 443 of the volute 43 is in communication with the fluid outlet 17 of the shell. The fluid entering the centrifugal compression mechanism through the flow passage 5 is compressed by the first-stage impeller 41 and then passes between an upper surface of the volute 43 and the partition 42. Then, the fluid is compressed by the second-stage impeller 44, and exits from the fluid outlet 17 through the outlet 443 of the volute so as to be supplied to devices downstream of the compressor.

As shown in FIG. 2, a guide member 3 is arranged above the centrifugal compression mechanism 4, and the guide member 3 may be directly supported by the volute 43, for example. In the illustrated embodiment, the guide member 3 and the top part 13 of the shell 1 together define the flow passage 5 that guides the fluid to detour or divert, thereby passing through the centrifugal compression mechanism 4 from top to bottom. In an alternative embodiment, the guide member 3 may define the flow passage 5 by itself. For example, the guide member 3 may be formed to have the flow passage 5, or the guide member 3 is assembled by a plurality of members to define the flow passage 5 together. In some embodiments, the guide member 3 has a hemispherical shape, and the inner side of the top part 13 of the shell may also be dome-shaped. In addition, in order to guide the fluid, an angle at which the airflow enters the impeller is adjusted to reduce the loss of airflow. In some embodiments, the top part 13 of the shell has an inward protrusion 14. In an alternative embodiment, the guide member 3 and the top part 13 of the shell may have any other suitable shapes.

In another aspect, a refrigerating device is provided, which includes the centrifugal compressor according to various embodiments.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A centrifugal compressor, comprising:

a shell, which has a fluid inlet at a first position of the shell, and a fluid outlet at a second position of the shell, which is higher than the first position;

a motor assembly, which is arranged in the shell and comprises a stator and a rotor, the rotor comprising a vertically arranged rotor shaft, and the rotor shaft comprising a lower end and an upper end;

a centrifugal compression mechanism, an impeller of which is connected with the rotor shaft so as to be driven by the motor assembly; and a guide member, which is located above the centrifugal compression mechanism, and which defines a flow passage alone or together with a top part of the shell;

wherein when the centrifugal compressor is working, a fluid from the fluid inlet passes through the motor assembly and then flows from an outer periphery of the centrifugal compression mechanism into the flow passage from bottom to top, is diverted in the flow passage, thereby enters the centrifugal compression mechanism from top to bottom, and exits from the fluid outlet;

wherein the motor assembly comprises:

a motor housing; and an oil cup at a top of the motor housing;

wherein the oil cup comprises an oil guide pipe that is arranged to guide oil in the oil cup to an oil tank at the bottom part of the shell;

wherein the motor assembly further comprises:

the stator fixed on an inner side of the motor housing;

the rotor located radially inwardly of the stator, the rotor being capable of rotating relative to the stator when energized;

a first bearing seat at a bottom of the motor housing and a first bearing therein;

and a second bearing bracket located above the oil cup and a second bearing therein.

2. The centrifugal compressor according to claim 1, wherein the lower end of the rotor shaft is located in the oil tank; and wherein the rotor shaft defines an axial or oblique oil passage therein, and has radial perforations at positions corresponding to the first bearing and the second bearing.

3. The centrifugal compressor according to claim 1, wherein an outer periphery of the second bearing bracket has a fluid passage that allows fluid to pass through from bottom to top.

4. The centrifugal compressor according to claim 1, wherein the centrifugal compression mechanism comprises one or more compression stages.

5. The centrifugal compressor according to claim 4, wherein the centrifugal compression mechanism comprises a first-stage impeller, a partition, a volute, and a second stage impeller, and wherein an outlet of the volute communicates with the fluid outlet of the shell, the fluid passes between an upper surface of the volute and the partition after being compressed by the first-stage impeller, is then compressed by the second-stage impeller, and then exits from the fluid outlet via the outlet of the volute.

6. The centrifugal compressor according to claim 5, wherein outer peripheries of the volute and the second bearing bracket have corresponding fluid passages to allow fluid to pass through from bottom to top.

7. The centrifugal compressor according to claim 1, wherein the guide member is hemispherical, and the top part of the shell has an inward protrusion.

8. A refrigerating device, comprising the centrifugal compressor according to claim 1.

9. A centrifugal compressor, comprising:

a shell, which has a fluid inlet at a first position of the shell, and a fluid outlet at a second position of the shell, which is higher than the first position;

a motor assembly, which is arranged in the shell and comprises a stator and a rotor, the rotor comprising a vertically arranged rotor shaft, and the rotor shaft comprising a lower end and an upper end;

a centrifugal compression mechanism, an impeller of which is connected with the rotor shaft so as to be driven by the motor assembly; and a guide member, which is located above the centrifugal compression mechanism, and which defines a flow passage alone or together with a top part of the shell;

wherein when the centrifugal compressor is working, a fluid from the fluid inlet passes through the motor assembly and then flows from an outer periphery of the centrifugal compression mechanism into the flow passage from bottom to top, is diverted in the flow passage, thereby enters the centrifugal compression mechanism from top to bottom, and exits from the fluid outlet;

wherein the motor assembly comprises:

a motor housing;

a stator fixed on an inner side of the motor housing;

a rotor located radially inwardly of the stator, the rotor being capable of rotating relative to the stator when energized;

a first bearing seat at a bottom of the motor housing and a first bearing therein;

an oil cup at a top of the motor housing; and a second bearing bracket located above the oil cup and a second bearing therein;

wherein the bottom of the motor housing is connected to the shell through a support bracket, the top of the motor housing is connected to the second bearing bracket, and the second bearing bracket is supported by the shell; and wherein the oil cup comprises an oil guide pipe that is arranged obliquely to guide oil in the oil cup to an inner wall of the shell so that the oil is returned to an oil tank at the bottom part of the shell.

* * * * *